US006183107B1

(12) United States Patent
Donato

(10) Patent No.: US 6,183,107 B1
(45) Date of Patent: Feb. 6, 2001

(54) MULTI-LAMP ASSEMBLY FOR MINIATURE LIGHTING STRIPS

(75) Inventor: Anthony C. Donato, Wellesley, MA (US)

(73) Assignee: Genlyte Thomas Group LLC, Louisville, KY (US)

( * ) Notice: Under 35 U.S.C. 154(b), the term of this patent shall be extended for 0 days.

(21) Appl. No.: 09/158,717

(22) Filed: Sep. 22, 1998

(51) Int. Cl.[7] ..... F21V 1/00
(52) U.S. Cl. ..... 362/238; 362/225; 362/220
(58) Field of Search ..... 362/249, 219, 362/225, 223, 240, 226, 238, 221, 217, 222, 227; 439/111, 239, 235

(56) References Cited

U.S. PATENT DOCUMENTS 1,917,860 * 7/1933 Wadsworth ..... 439/698
4,628,421 * 12/1986 Saar ..... 362/238
4,654,765 * 3/1987 Laidman ..... 362/238
4,979,081 * 12/1990 Leach ..... 362/220
5,107,408 * 4/1992 Vernondier ..... 362/238
5,785,411 * 7/1998 Komai ..... 362/225

* cited by examiner

*Primary Examiner*—Sandra O'Shea
*Assistant Examiner*—Hargobind S. Sawhney

(57) ABSTRACT

A multi-lamp assembly for a lighting strip includes an elongated housing from which a plurality of spaced lamp contact housings extend. Each lamp contact housing includes at least one opening that receives the free upper end of an electrical contact mounted at its lower end to a printed circuit board that is received within the interior of the elongated housing. The contacts of series-connected lamps are inserted into the openings of adjacent lamp contact housings, thereby to engage a pair of the electrical contacts therein.

1 Claim, 3 Drawing Sheets

MULTI-LAMP ASSEMBLY FOR MINIATURE LIGHTING STRIPS

BACKGROUND OF THE INVENTION

The present invention relates generally to multiple lamp assemblies, and more particularly to a multiple lamp assembly for use in a lighting strip fixture.

A lighting strip fixture in which a plurality of lamps, usually high-intensity or miniature lamps, are mounted along an elongated fixture and electrically connected in series, is commonly used to provide decorative and high-lighting effects, such as under kitchen cabinets, in office reception areas, and in restaurants. Other areas of use for multiple lamp fixtures include inside cove details and behind baffles. The housing in a typical lighting strip is shallow so that it does not protrude below a shallow facia panel and is hidden from view at normal viewing angles.

Another feature of such lighting strips is their use of a plurality of spaced, low-voltage lamps arranged along a line that distribute light evenly without creating an area of concentrated heat at any one location, thereby significantly reducing the risk of fire and the formation of scorch marks on furniture.

Since, as noted, the lamps used in lighting strips are typically connected in series, if one or more of the lamps is removed or burns out, the series circuit connection is broken and all the remaining active lamps cease to operate. It has been proposed to include an internal bypass circuit, which simulates the load of a lamp that is removed or burns out, thereby to maintain the series connection between the remaining lamps and allow them to continue to operate. A plurality of low-voltage lamps (e.g., 12 volts or 24 volts) can thus be reliably connected in series across a higher conventional a.c. source of 120 volts, without the need for a voltage-reducing transformer. The known lighting strips that contain a bypass circuit of this type, such as a circuit developed by Leviton Manufacturing Company, require point-to-point wiring between lampholders and/or mechanical mountings for each lamp, which adds to the cost and complexity of fabricating the multi-lamp lighting strip.

SUMMARY OF THE INVENTION

It is accordingly an object of the present invention to provide a multi-lamp assembly for a lighting strip that is simpler and less costly to fabricate.

It is another object of the invention to provide a lighting strip lamp assembly, which reliably operates with a plurality of series-connected, low-voltage lamps.

It is a more general object of the invention to provide a low-cost, low-profile compact lamp assembly for use in a multi-lamp lighting strip fixture.

To these ends, the multi-lamp assembly of the invention includes an elongated housing that includes a plurality of spaced lamp sockets extending from its upper surface. The interior of the housing receives a printed circuit board to which are secured the lower ends of spaced contacts. The free upper ends of these contacts are respectively received within the lamp contact housings and are thus accessible to make contact with lamp contacts that are inserted between adjacent lamp housings. The components of a bypass circuit which simulates a lamp load in the event of lamp removal or lamp failure may be mounted and interconnected on the printed circuit board.

BRIEF DESCRIPTION OF THE DRAWINGS

The above-mentioned and other objects and features of the present invention will be best understood when considered in conjunction with the following description of a preferred embodiment of the invention, as considered along with the accompanying drawings, in which.

DETAILED DESCRIPTION OF A PREFERRED EMBODIMENT

Figure 1:
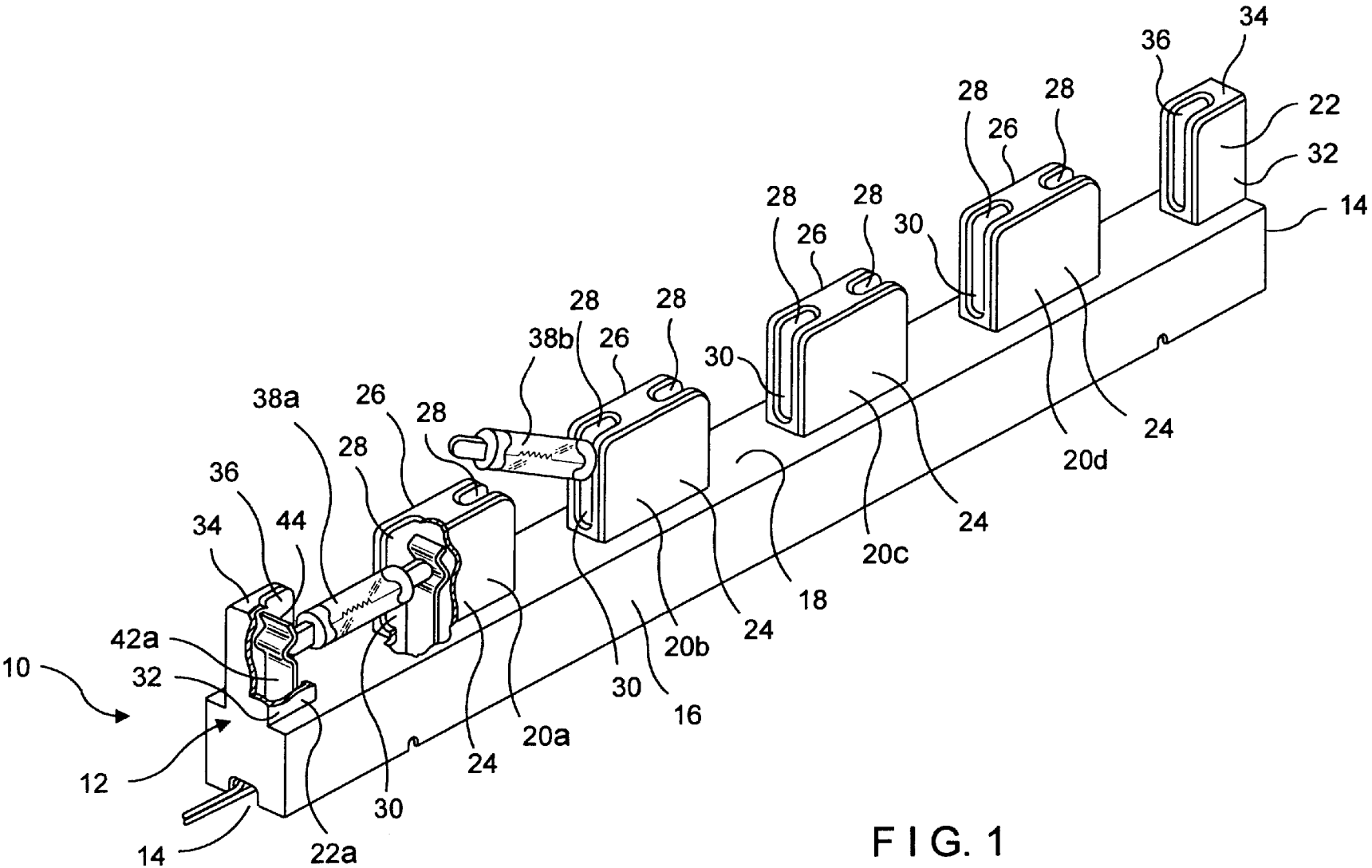
FIG. 1 is a perspective of a multi-lamp assembly for use in a lighting strip fixture according to an embodiment of the invention, with one lamp installed and another lamp partially installed.

As in the embodiment shown in FIG. 1, the multi-lamp assembly of the present invention, generally designated 10, includes an elongated housing 12 made of any suitable insulating material such as, for example, polycarbonate. Housing 12 includes end walls 14, side walls 16, and an upper surface 18.

Extending upwardly from the upper surface 18 of housing 12, inboard from its opposite ends, are a plurality of longitudinally spaced double-ended lamp-contact housings. A pair of single-ended lamp-contact housings sockets 22 extend upwardly from each end of the upper surface 18 of housing 12. Housing 20 include a pair of upstanding side walls 24 and a transverse upper wall 26 extending between walls 24. Lateral U-shaped cutouts 28 provided at each end of wall 26 extend to vertical openings 30 formed along each end of sockets 20. End sockets 22 similarly include spaced parallel vertical walls 32 and a transverse upper wall 34 that includes a single U-shaped cutout 35 that extends to a vertical opening 36 in the end wall of housing 22.

As shown in FIG. 1, the opposed end contacts of miniature low-voltage lamps 38 are respectively inserted into the vertical openings 30 or 36 of adjacent housing 20 or 22 to receive the appropriate operating voltage in a manner described in greater detail below with reference to FIG. 2. Thus, for example, one end contact of a lamp 38*a* is inserted into opening 36 of end housing 22*a*, and the other contact of lamp 38*a* is inserted into the left-hand vertical opening 30 of adjacent socket 20*a*.

Similarly, a lamp 38*b* is shown with one contact inserted into the left-hand vertical opening 30 of housing 20*b* and its other contact about to be inserted into the right-hand vertical opening 30 of adjacent housing 20*a*. The multi-lamp assembly shown in FIG. 1 is capable of accommodating five series-connected lamps in this manner.

Figure 2:
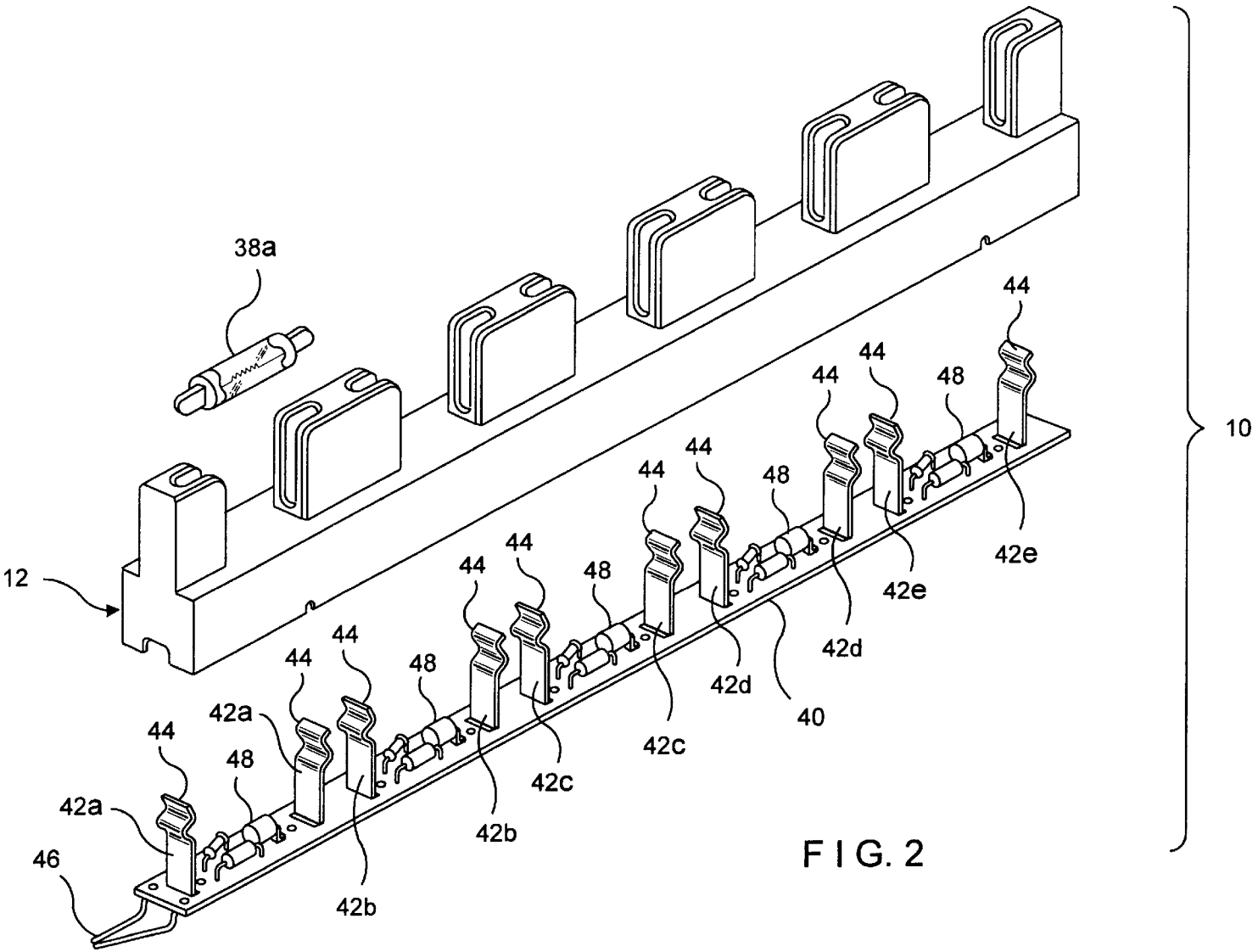
FIG. 2 is an exploded, perspective of the multi-lamp assembly of FIG. 1.

Referring now to FIG. 2, there is shown an elongated printed circuit board 40, which is inserted into the interior of housing 12 to form the assembly of FIG. 1. As shown in FIG. 2, circuit board 40 includes a plurality of upstanding resilient metal electrical contacts 42 each of which is secured at its lower end to circuit board 40 and terminates at its upper, free end in a W-5 shaped section 44. Contacts 42 are arranged in pairs, one contact pair being provided for each lamp 38 to be included in the assembly. Thus, five contact pairs 42*a*–42*e* are shown secured to the circuit board 40 shown in FIG. 2.

When circuit board 40 is received within housing 12, as in FIG. 1, one pair of the relatively closely spaced contacts 42 is received within the interior of each of the double-ended contact housings 20, and a single contact, such as the left-hand contact 42*a*, is received within the interior of single-ended contact housing 22. Two contacts 42, such as contacts 42*a*, are thus received within confronting vertical openings 30 of adjacent housings 20, or between an opening 30 of an interior double-ended housing 20 and an opening 36 of an end housing 22. For example, the left-hand contact 42*a* extends into the vertical opening 36 of end housing 22*a*, and the right-hand contact 42*a* extends into the confronting left-hand opening 36 of housing 20*a*, In this manner, contacts 42 are received within the housings 20 or 22, as the case may be, so that the upper ends 44 of the contacts 42 extend into the openings 30 or 36 of the housing at which the contact within that opening is accessible to and thus able to make electrical contact with a lamp contact inserted into that housing opening.

Figure 3:
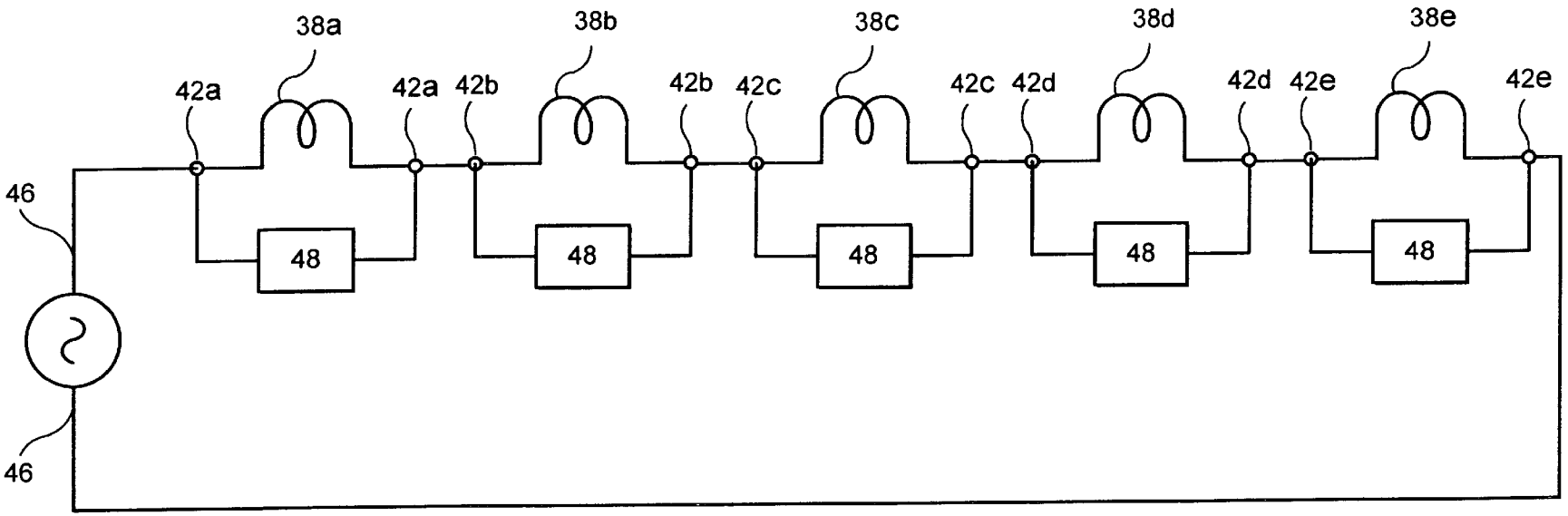
FIG. 3 is a schematic diagram illustrating the series connection of a plurality of lamps in the multi-lamp assembly of FIG. 1.

An AC voltage, typically at 120 v, is applied to the circuit board 40 by means of wires 46. As illustrated in the schematic diagram of FIG. 3, the pairs of contacts 42*a*–42*e* are connected in series as are the lamps 38*a*–38*e* inserted respectively between adjacent housings 20, 22 and connected there to the contacts 42 and to the AC voltage on wires 46. As described previously, in order to maintain the operation of the series-connected lamps mounted in the lighting strip assembly, even when one of the lamps is removed or fails, the remaining lamps remain on by bypassing the contacts of the failed or removed lamp to a parallel-connected dummy load 48. The components of the switching and dummy load circuits, which are designated schematically in FIG. 2 at 48, are mounted on circuit board 40 at the locations of each lamp. A bypass circuit such as that developed by Leviton Manufacturing Company can be used to advantage for this purpose.

It is to be understood that the details or particular arrangement of the dummy load bypass and switching circuit are not per se the subject of the present invention, and that no specific circuit for performing these functions is herein described. It will also be understood that although the present invention has been described hereinabove with respect to a currently preferred embodiment, modifications may be made therein, such as the use of a lesser or greater number of series-connected lamps, without necessarily departing from the spirit and scope of the invention as defined in the appended claims.

What is claimed is:

1. An assembly for use in a lighting strip comprising an elongated housing having an upper surface and an interior, a plurality of lamp contact housings longitudinally spaced on said upper surface, a circuit board inserted into said elongated housing interior, a plurality of spaced electrical contacts secured at their lower ends to said circuit board, said electrical contacts having upper free ends extending into said lamp contact housings and being accessible therein for making electrical contact with a lamp contact, said lamp contact housings including single-ended housings located at the opposite ends of said upper surface of said elongated housing and at least one double-ended housing on said upper surface of said elongated housing intermediate said single-ended housings, said sockets including an opening at at least one side thereof, said upper free ends of said electrical contact being respectively received within said sockets and accessible to lamp contact via said openings, a pair of lamp contacts being inserted respectively into openings in adjacent ones of said lamp sockets, thereby to make an electrical connection with said electrical contacts within said sockets through said openings.

* * * * *